US011296423B2

(12) United States Patent
Gonzalez Jimenez et al.

(10) Patent No.: US 11,296,423 B2
(45) Date of Patent: Apr. 5, 2022

(54) RECONFIGURABLE TRANSMITARRAY ANTENNA WITH MONOLITHIC INTEGRATION OF ELEMENTARY CELLS

(71) Applicant: Commissariat a l'Energie Atomique et aux Energies Alternatives, Paris (FR)

(72) Inventors: José-Luis Gonzalez Jimenez, Grenoble (FR); Antonio Clemente, Grenoble (FR)

(73) Assignee: Commissariat a l'Energie Atomique et aux Energies Alternatives, Paris (FR)

( * ) Notice: Subject to any disclaimer, the term of this patent is extended or adjusted under 35 U.S.C. 154(b) by 0 days.

(21) Appl. No.: 17/124,876

(22) Filed: Dec. 17, 2020

(65) Prior Publication Data

US 2021/0194152 A1 Jun. 24, 2021

(30) Foreign Application Priority Data

Dec. 18, 2019 (FR) ..... 19 14720

(51) Int. Cl.
*H01Q 1/38* (2006.01)
*H01Q 21/00* (2006.01)
(Continued)

(52) U.S. Cl.
CPC ..... *H01Q 21/0087* (2013.01); *H01Q 1/2283* (2013.01); *H01Q 21/065* (2013.01)

(58) Field of Classification Search
CPC ..... H01Q 21/0087; H01Q 1/2283; H01Q 21/055; H01Q 21/0093
(Continued)

(56) References Cited

U.S. PATENT DOCUMENTS

2017/0033462 A1 2/2017 Clemente et al.
2017/0062945 A1* 3/2017 Foo ..... H01Q 15/10
(Continued)

FOREIGN PATENT DOCUMENTS

EP 3 125 362 A1 2/2017
EP 3 392 959 A1 10/2018

OTHER PUBLICATIONS

French Preliminary Search Report dated Oct. 1, 2020 in French Application 19 14720 filed Dec. 18, 2019 (with English Translation of Categories of Cited Documents and Written Opinion), 12 pages.
(Continued)

*Primary Examiner* — Peguy Jean Pierre
(74) *Attorney, Agent, or Firm* — Oblon, McClelland, Maier & Neustadt, L.L.P.

(57) ABSTRACT

A structure including a first wafer, including first active components configured so as to introduce a phase shift; a first metal layer, formed on a first surface of the first wafer; a first interconnect structure, formed on a second surface of the first wafer, including first bias lines; a set of first planar antennas, formed on the first interconnect structure; a second wafer; a second metal layer, formed on a first surface of the second wafer; a set of second planar antennas, formed on a second surface of the second wafer; the first and second wafers being joined by way of the first and second metal layers such that the first and second planar antennas are aligned, the first and second metal layers forming a ground plane.

16 Claims, 5 Drawing Sheets

(51) Int. Cl.
*H01Q 1/22* (2006.01)
*H01Q 21/06* (2006.01)

(58) Field of Classification Search
USPC ..... 343/702
See application file for complete search history.

(56) References Cited

U.S. PATENT DOCUMENTS

2018/0301807 A1 10/2018 Clemente et al.
2019/0288403 A1* 9/2019 Clemente ..... H01Q 21/061

OTHER PUBLICATIONS

Zevallos Luna, J A., "Intégration d'antennes pour objets communicants aux fréquences millimétriques," Electronique, https://core.ac.uk/download/pdf/46807883.pdf, XP002800325, 190 pages.

* cited by examiner

RECONFIGURABLE TRANSMITARRAY ANTENNA WITH MONOLITHIC INTEGRATION OF ELEMENTARY CELLS

TECHNICAL FIELD

The invention relates to the technical field of transmitarray antennas. A transmitarray antenna comprises:

a transmitarray (also called electromagnetic lens or discrete lens), comprising a set of elementary cells able to be arranged in a matrix (the matrix may be regular or sparse; the regular matrix may for example comprise a square or triangular mesh);

at least one radiating source (called primary source), designed to illuminate the transmitarray.

Each elementary cell of the transmitarray is capable of introducing a phase shift onto the incident wave emitted by the primary source or sources, in order to compensate each path difference of the radiation emitted between the primary source or sources and the transmitarray. The elementary cells make it possible to generate the phase law in the radiation aperture in order to form the desired radiation for the antenna.

More precisely, each elementary cell of the transmitarray may comprise at least:

a first planar antenna (called receive antenna), designed to receive the incident wave emitted by the primary source or sources;

a second planar antenna (called transmit antenna), designed to transmit, with a phase shift, the incident wave received by the first planar antenna.

"Planar antenna" is understood to mean an electrically conductive flat surface (normally made of metal) able to emit/receive electromagnetic radiation. One example of a planar antenna is the micro-strip patch.

Other elementary cell architectures may also be used, such as multilayer structures based on the concept of frequency-selective surfaces, or on the concept of Fabry-Perot cavities. Radiating elements such as dipoles, slots etc. may also be used in the elementary cell.

It should be noted that an elementary cell of a transmitarray is able to operate in receive mode or in transmit mode, that is to say that the first planar antenna of the elementary cell may also be a transmit antenna, while the second planar antenna of the elementary cell may also be a receive antenna.

The invention is applicable notably for obtaining a reconfigurable antenna. "Reconfigurable" is understood to mean that at least one feature of the antenna may be modified over its service life, after it has been manufactured. The feature or features generally able to be modified are the frequency response (in terms of amplitude and in terms of phase), the radiation pattern (also called beam), and the polarization. Reconfiguring the frequency response covers various functionalities, such as frequency switching, frequency tuning, bandwidth variation, phase shift, frequency filtering etc. Reconfiguring the radiation pattern covers various functionalities, such as angular scanning of the beam pointing direction (also called depointing), the aperture of the beam typically defined at half-power (that is to say the concentration of the radiation in a particular direction), spatial filtering (linked to the aperture and to the formation of the beam), beamforming or multi-beamforming (for example a plurality of narrow beams replacing a wide beam) etc. A reconfigurable transmitarray antenna is particularly advantageous from the C band (4-8 GHz) up to the W band (75-110 GHz), or even the D band (110-170 GHz) or up to the 300 GHz band, for the following applications:

automotive driving assistance and driving aid radars, from an active safety perspective, very-high-resolution imaging and surveillance systems, very-high-rate communication systems, operating notably in millimetre bands (inter-building or intra-building communications in a home automation or building automation environment, and particularly suitable for monitoring users), LEO (for "Low Earth Orbit") low-orbit ground-satellite telemetry links in the Ka band, satellite telecommunications with a reconfigurable primary source (SOTM™ for "Satcom-on-the-Move", Internet, television etc.), point-to-point and point-to-multipoint link systems (metropolitan networks, "Fronthaul" and "Backhaul" systems for cellular networks, radio access for fifth-generation mobile networks, etc.).

PRIOR ART

The millimetre frequency bands are of great interest for radio communication systems, by virtue of wide spectral bands that are available, allowing high transmission rates. For example, the band around 60 GHz (57-66 GHz) is a free band, which may be operated without a license worldwide, and which is therefore of great interest. Wireless communications around 60 GHz are however limited:

firstly by the resonance of dioxygen molecules present in the air, which absorb a large portion of the energy emitted by the radio communication system, secondly by losses linked to the propagation of electromagnetic waves in free space (denoted FSPL for "Free-Space Path Loss"), which follow a quadratic law with respect to the operating frequency:

$$FSPL = \left(\frac{4\pi d f}{c}\right)^2$$

where "d" is the distance between two antennas, "f" is the operating frequency, and "c" is the speed of the electromagnetic waves (that is to say the speed of propagation in a vacuum).

As a result, the radio communication system requires a high gain. This problem is common to millimetre and sub-THz frequencies starting from 30 GHz.

It is known from the prior art, in particular from the doctoral thesis by J. A. Zevallos Luna, "Intégration d'antennes pour objets communicants aux fréquences millimétriques" [Integration of antennas for communicating objects at millimetre frequencies], October 2014 (hereinafter D1), to combine a transceiver module with a passive transmitarray (cf. FIG. 6.1 of D1, and paragraph 5.4). The transmitarray is printed on a dielectric substrate (cf. FIG. 6.2 *a*) of D1). The integrated circuit of the transceiver is formed on a printed circuit board. The transmitarray is formed on the printed circuit board, facing the transceiver, by way of dielectric pillars supporting the dielectric substrate.

Such a solution from the prior art is not entirely satisfactory insofar as the dielectric pillars are detrimental to the compactness of the radio communication system. Furthermore, the antenna that is obtained is not reconfigurable due to the passive transmitarray.

DESCRIPTION OF THE INVENTION

The invention aims to rectify all or some of the above-mentioned drawbacks. To this end, one subject of the invention is a structure for manufacturing integrated circuits that are intended to provide an electromagnetic lens function for a reconfigurable transmitarray antenna, the structure comprising:

a first wafer, comprising a set of first active components configured so as to introduce a phase shift, and having opposing first and second surfaces;

a first metal layer, formed on the first surface of the first wafer;

a first interconnect structure, formed on the second surface of the first wafer, and electrically connected to the first active components; the first interconnect structure comprising first bias lines designed to bias the first active components;

a set of first planar antennas, formed on the first interconnect structure;

a second wafer, having opposing first and second surfaces;

a second metal layer, formed on the first surface of the second wafer;

a set of second planar antennas, formed on the second surface of the second wafer;

the first and second wafers being joined by way of the first and second metal layers such that the sets of the first and second planar antennas are aligned, the first and second metal layers forming a ground plane.

The set of first planar antennas is formed on the first interconnect structure such that each first planar antenna is electrically connected to the first active components.

The set of first planar antennas is formed on the first interconnect structure such that the first planar antennas are electrically isolated from one another so as not to be short-circuited.

The set of second planar antennas is formed on the second surface of the second wafer such that the second planar antennas are electrically isolated from one another so as not to be short-circuited.

Definitions

"Electromagnetic lens" is understood to mean a transmitarray, also called a discrete lens.

"Wafer" is understood to mean a self-supporting physical support, made of a base material allowing the monolithic integration of an electronic device, or of an electronic/electro-optical component, or else an electromechanical system (MEMS or NEMS). By way of non-limiting example, a wafer may be a segment cut from a monocrystalline ingot of semiconductor material. A wafer may also be made of a dielectric material such as quartz. It is also possible to contemplate a semiconductor-on-insulator (SeOl) wafer, preferably a silicon-on-insulator (SOI) wafer.

"Semiconductor" is understood to mean that the material has a conductivity at 300 K of between $10^{-8}$ $S.cm^{-1}$ and $10^{2}$ $S.cm^{-1}$.

"Active components" are understood to mean components that make it possible to act, using a control signal (for example an electronic or optical control signal), on the propagation characteristics of an electromagnetic wave. The active components are conventionally integrated monolithically into the wafer by an FEOL ("Front-End-Of-Line") initial manufacturing unit, using for example photolithography, etching, dopant diffusion and implantation, metal deposition, passivation etc. techniques. The active components are preferably switches.

"Phase shift" is understood to mean a modification of the phase of an incident electromagnetic wave, introduced by the active component or components, for example by causing a time shift (time delay) of the incident electromagnetic wave.

"Interconnect structure" is understood to mean a stack of interconnect levels comprising metal tracks embedded in a dielectric material. An interconnect structure is conventionally formed on the wafer by a BEOL ("Back-End-Of-Line") final manufacturing unit.

"Dielectric material" is understood to mean that the material has an electrical conductivity at 300 K of less than $10^{-8}$ S/cm.

"Planar antenna" is understood to mean an electrically conductive flat surface (normally made of metal) able to emit/receive electromagnetic radiation. One example of a planar antenna is the micro-strip patch.

The expression "a set of second planar antennas, formed on the second surface of the second wafer" does not necessarily mean that the second planar antennas are formed directly on the second surface of the wafer. This expression does not rule out the presence of an entity interposed between the second surface of the second wafer and the second planar antennas, for example an interconnect structure.

"Ground plane" is understood to mean a metallic region forming an electrical ground plane so as to define a reference potential.

Such a structure according to the invention thus allows monolithic integration of the elementary cells of the transmitarray with the first active components, making it possible to control and modify the phase shift introduced into the corresponding elementary cell, and to do so in such a way as to be able to obtain a reconfigurable antenna.

In addition, such monolithic integration will make it possible to obtain, in the future, an integrated circuit with dimensions small enough to be compatible with reconfigurable antenna operating frequencies greater than 30 GHz. Specifically, in order to obtain satisfactory performance, the characteristic dimension (and therefore the periodicity) of the elementary cells should be less than or equal to the half-wavelength of the electromagnetic waves emitted by the primary source or sources. For example, when the operating frequency is 30 GHz, the characteristic dimension of the elementary cells should be less than or equal to 0.5 cm.

The structure according to the invention may comprise one or more of the following features.

According to one feature of the invention, the set of first active components comprises pairs of switches, each pair of switches being associated with a first planar antenna.

Definition

"Switches" are understood to mean elements that make it possible to authorize or prohibit the flow of an electric current, for example between two separate radiating surfaces of a planar antenna.

One advantage that is afforded is thus that of being able to introduce a phase shift by modifying the effective electrical length of the first planar antenna.

According to one feature of the invention, the first wafer comprises a first demultiplexer configured so as to transmit a control signal on the first bias lines.

One advantage that is afforded is thus that of obtaining monolithic integration of the first demultiplexer with the elementary cells of the transmitarray and the first active components.

According to one feature of the invention, the second wafer comprises a set of second active components configured so as to introduce a phase shift; the structure comprising a second interconnect structure, formed on the second surface of the second wafer, and electrically connected to the second active components; the second interconnect structure comprising second bias lines designed to bias the second active components; the set of second planar antennas being formed on the second interconnect structure.

The set of second planar antennas is formed on the second interconnect structure such that each second planar antenna is electrically connected to the second active components.

The set of second planar antennas is formed on the second interconnect structure such that the second planar antennas are electrically isolated from one another so as not to be short-circuited.

One advantage that is afforded is thus that of increasing the number of phase states or delays.

According to one feature of the invention, the set of second active components comprises pairs of switches, each pair of switches being associated with a second planar antenna.

One advantage that is afforded is thus that of being able to introduce a phase shift by modifying the effective electrical length of the second planar antenna.

According to one feature of the invention, the second wafer comprises a second demultiplexer configured so as to transmit a control signal on the second bias lines.

One advantage that is afforded is thus that of obtaining monolithic integration of the second demultiplexer with the elementary cells of the transmitarray and the second active components.

According to one feature of the invention, the structure comprises vias designed to electrically connect the first planar antennas with the second planar antennas facing them, the vias being electrically isolated from the ground plane.

Definition

"Via" is understood to mean a metallized hole making it possible to establish an electrical connection between various interconnect levels.

According to one feature of the invention, each first planar antenna comprises separate first and second radiating surfaces; the first radiating surfaces of the first planar antennas being electrically connected to the vias; the second radiating surfaces of the first planar antennas being electrically connected to the first active components.

Definition

"Separate" is understood to mean that the first and second radiation surfaces are separated from one another by a separating region so as to be electrically isolated.

According to one feature of the invention, each second planar antenna comprises separate first and second radiating surfaces; the first radiating surfaces of the second planar antennas being electrically connected to the vias; the second radiating surfaces of the second planar antennas being electrically connected to the second active components.

According to one feature of the invention, the first active components and/or the second active components are chosen from among a diode, a field-effect transistor, a bipolar transistor, a microelectromechanical system.

According to one feature of the invention, the structure comprises solder balls designed to establish a metallic bond between the first and second metal layers.

One advantage that is afforded is thus that of obtaining strong adhesion between the first and second metal layers, and guaranteeing an electrical interconnection.

According to one feature of the invention, the first and second wafers are based on a semiconductor material, or consist of a semiconductor material.

Definitions

"Based on" is understood to mean that the semiconductor material is the main and majority material forming the wafer.

"Consisting of" is understood to mean that the semiconductor material is the one and only material forming the wafer.

One advantage that is afforded is thus that of facilitating the monolithic integration of the first and second active components, with a high possible integration density.

Another subject of the invention is an integrated circuit, manufactured by cutting a structure according to the invention, the cutting being performed such that the integrated circuit comprises a plurality of elementary cells, each comprising a first planar antenna and a second planar antenna facing it, so as to provide an electromagnetic lens function.

In other words, one subject of the invention is an integrated circuit, intended to provide an electromagnetic lens function for a reconfigurable transmitarray antenna, manufactured by cutting a structure according to the invention, the integrated circuit comprising:

a portion of the first wafer, comprising first active components configured so as to introduce a phase shift, and having opposing first and second surfaces;

a part of the first metal layer, formed on the first surface of the portion of the first wafer;

a part of the first interconnect structure, formed on the second surface of the portion of the first wafer, and electrically connected to the first active components; the part of the first interconnect structure comprising first bias lines designed to bias the first active components;

a part of the set of first planar antennas, formed on the part of the first interconnect structure;

a portion of the second wafer, having opposing first and second surfaces;

a part of the second metal layer, formed on the first surface of the portion of the second wafer;

a part of the set of second planar antennas, formed on the second surface of the portion of the second wafer;

the portions of the first and second wafers being joined by way of the parts of the first and second metal layers such that the parts of the sets of the first and second planar antennas are aligned, the parts of the first and second metal layers forming a ground plane, the integrated circuit comprising a plurality of elementary cells, each comprising a first planar antenna and a second planar antenna facing it, so as to provide an electromagnetic lens function.

Another subject of the invention is a reconfigurable transmitarray antenna, comprising:

a printed circuit board, having opposing first and second surfaces;

at least one integrated circuit according to the invention, formed on the first surface of the printed circuit board;

at least one transceiver, designed to emit and receive an electromagnetic wave propagating within the printed circuit board;

at least one control electronics component, configured so as to control the transceiver and the first active components of the integrated circuit, and formed on the second surface of the printed circuit board.

One advantage that is afforded is thus that of obtaining a highly compact reconfigurable transmitarray antenna by using the two opposing faces of a printed circuit board to integrate the electromagnetic lens and the control electronics.

According to one feature of the invention, the integrated circuit is manufactured by cutting a structure according to the invention, and the control electronics are configured so as to control the second active components of the integrated circuit.

According to one feature of the invention, the antenna comprises additional planar antennas formed on the first surface of the printed circuit board, and facing the elementary cells of the integrated circuit.

One advantage that is afforded is thus that of obtaining a transmitarray capable of managing independent beams, for example for multi-user applications.

BRIEF DESCRIPTION OF THE DRAWINGS

Other features and advantages will become apparent in the detailed description of various embodiments of the invention, the description being accompanied by examples and references to the accompanying drawings.

The figures are not shown to scale for the sake of legibility and for ease of understanding thereof.

DETAILED DESCRIPTION OF THE EMBODIMENTS

Elements that are identical or perform the same function will bear the same references for the various embodiments, for the sake of simplicity.

One subject of the invention is a structure 1 for manufacturing integrated circuits IC that are intended to provide an electromagnetic lens function for a reconfigurable transmitarray antenna 2, the structure 1 comprising:

a first wafer W1, comprising a set of first active components C1 configured so as to introduce a phase shift, and having opposing first and second surfaces W10, W11;

a first metal layer M1, formed on the first surface W10 of the first wafer W1;

a first interconnect structure 3, formed on the second surface W11 of the first wafer W1, and electrically connected to the first active components C1; the first interconnect structure 3 comprising first bias lines 30 designed to bias the first active components C1;

a set of first planar antennas A1, formed on the first interconnect structure 3;

a second wafer W2, having opposing first and second surfaces W20, W21;

a second metal layer M2, formed on the first surface W20 of the second wafer W2;

a set of second planar antennas A2, formed on the second surface W21 of the second wafer W2;

the first and second wafers W1, W2 being joined by way of the first and second metal layers M1, M2 such that the sets of the first and second planar antennas A1, A2 are aligned, the first and second metal layers M1, M2 forming a ground plane PM.

Figure 4:
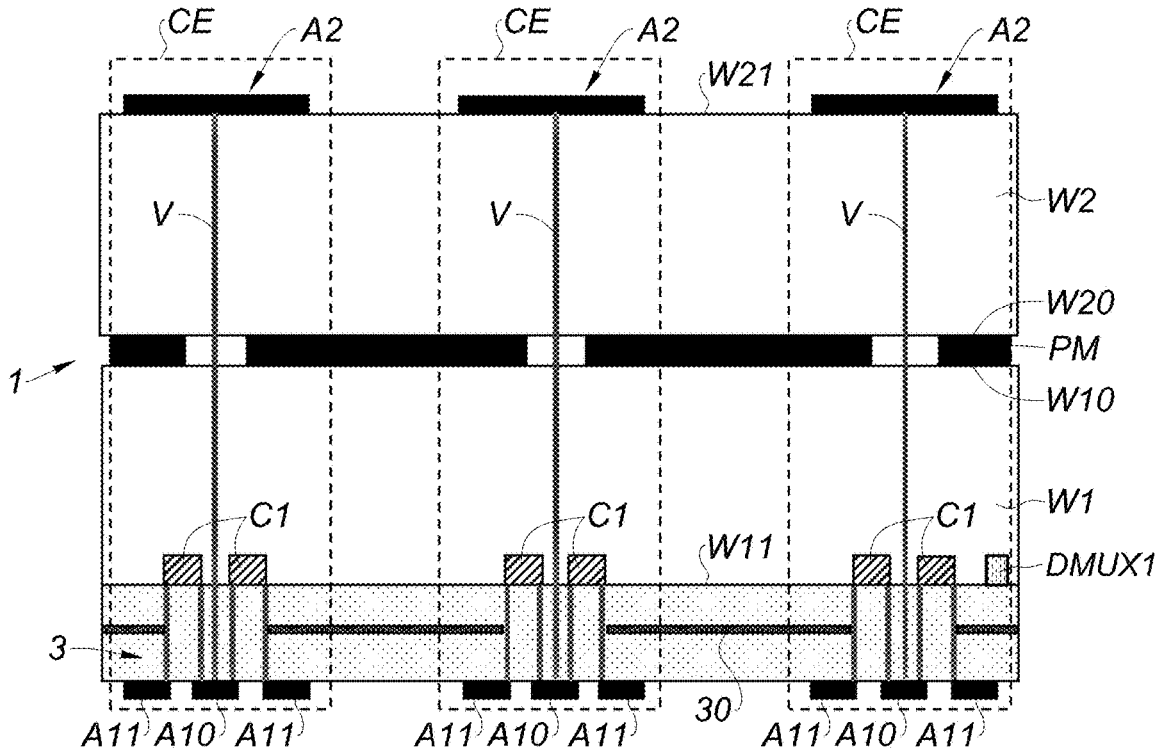
FIG. 4 is a schematic sectional view of a structure according to the invention, illustrating an embodiment where the second wafer does not have any active components. The dashed lines indicate an elementary cell of the transmitarray.
Figure 5:
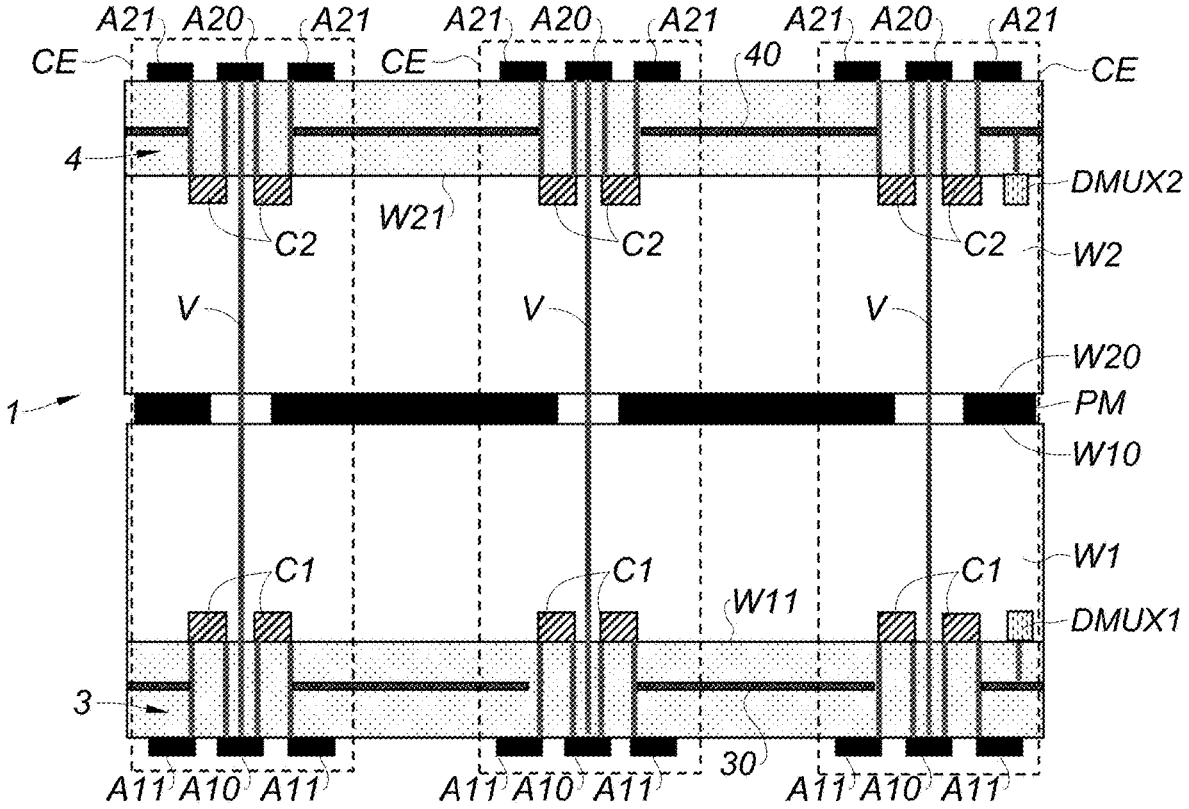
FIG. 5 is a schematic sectional view of a structure according to the invention, illustrating an embodiment where the second wafer is provided with second active components. The dashed lines indicate an elementary cell of the transmitarray.

Some examples of a structure 1 are illustrated in FIGS. 4 and 5.

First Wafer

Figure 1:
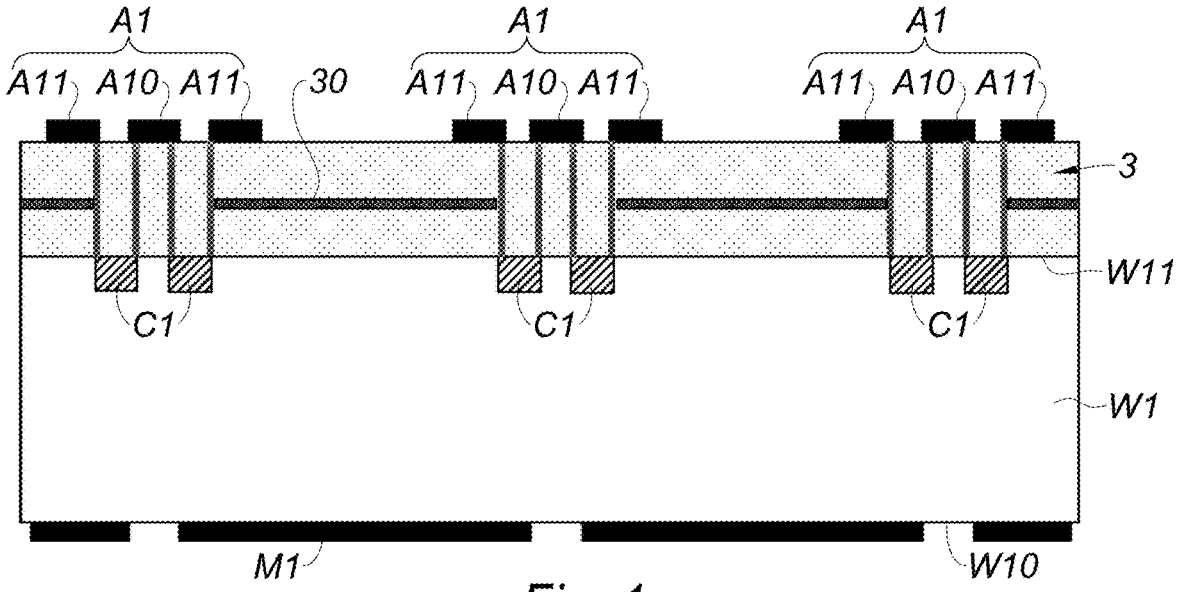
FIG. 1 is a partial schematic sectional view of a structure according to the invention, illustrating the first wafer provided with the first active components, the first interconnect structure, the first planar antennas and the first metal layer.

The first wafer W1 is notably illustrated in FIG. 1. The first wafer W1 is advantageously made from a semiconductor material, preferably selected from among silicon and germanium. The first wafer W1 may therefore be a semiconductor. The first wafer W1 may be based on a semiconductor material. The first wafer W1 may consist of a semiconductor material.

The first wafer W1 may also be made from a dielectric material such as quartz. It is also possible to contemplate a semiconductor-on-insulator (SeOI) first wafer W1, preferably a silicon-on-insulator (SOI) first wafer.

First Active Components

The first active components C1 are advantageously integrated into the first wafer W1 by an FEOL ("Front-End-Of-Line") initial manufacturing unit, using for example photolithography, etching, dopant diffusion and implantation, metal deposition, passivation techniques known to a person skilled in the art. If the first wafer W1 is made from a dielectric material, the first active components C1 may be integrated into the first wafer W1 using thin-film deposition techniques.

Each first planar antenna A1 advantageously comprises separate first and second radiating surfaces A10, A11, separate in the sense that they are separated from one another by a separating region so as to be electrically isolated from one another. The set of first active components C1 advantageously comprises pairs of switches, each pair of switches being associated with a first planar antenna A1. Each pair of switches belongs to a phase shift circuit, and comprises first and second switches respectively alternately having an on state and an off state, the on or off states corresponding to a respectively authorized or blocked flow of a current between the separate first and second radiating surfaces A10, A11 of each first planar antenna A1. "Alternately" is understood to mean that the first switch alternates between the on state and the off state, while, simultaneously, the second switch alternates between the off state and the on state. In other words, at all times, the first and second switches belonging to the same phase shift circuit have two opposing states, either on/off or off/on. On/on or off/off states are not authorized.

The first active components C1 are advantageously chosen from among a diode, a field-effect transistor, a bipolar transistor, a microelectromechanical system. The field-effect transistor is preferably a MOS ("Metal Oxide Semiconductor") transistor. The diode may be a PIN diode, an electro-optical diode, or else a varactor diode. PIN diodes may be made from AlGaAs.

First Metal Layer

The first metal layer M1 is preferably made from copper. The first metal layer M1 may be formed on the first surface W10 of the first wafer W1 through a metallization process.

First Interconnect Structure

The first interconnect structure 3 is advantageously formed on the second surface W11 of the first wafer W1 by a BEOL ("Back-End-Of-Line") final manufacturing unit.

The first bias lines 30 are metal tracks, preferably made from copper.

The first wafer W1 advantageously comprises a first demultiplexer DMUX1 configured so as to transmit a control signal on the first bias lines 30. In order to limit the number of inputs (and therefore the number of wires), for the sake of compactness, it is possible to organize the first bias lines 30 in matrices, and to provide an address decoder.

Set of First Planar Antennas

The set of first planar antennas A1 is formed on the first interconnect structure 3 such that each first planar antenna A1 is electrically connected to the first active components C1. The set of first planar antennas A1 is formed on the first interconnect structure 3 such that the first planar antennas A1 are electrically isolated from one another so as not to be short-circuited.

As mentioned above, each first planar antenna A1 advantageously comprises separate first and second radiating surfaces A10, A11, separate in the sense that they are separated from one another by a separating region so as to be electrically isolated from one another. To this end, a slot is advantageously formed in each first planar antenna A1 in order to electrically isolate the separate first and second radiating surfaces A10, A11. The slot defines the separating region. The slot is preferably annular, with a rectangular cross section. Of course, other shapes may be contemplated for the slot, such as an elliptical or circular shape. According to one variant implementation, the first and second radiating surfaces of the second planar antenna may be electrically isolated by a dielectric material.

The first and second radiating surfaces A10, A11 of the first planar antennas A1 are electrically connected to the first active components C1

Second Wafer

Figure 2:
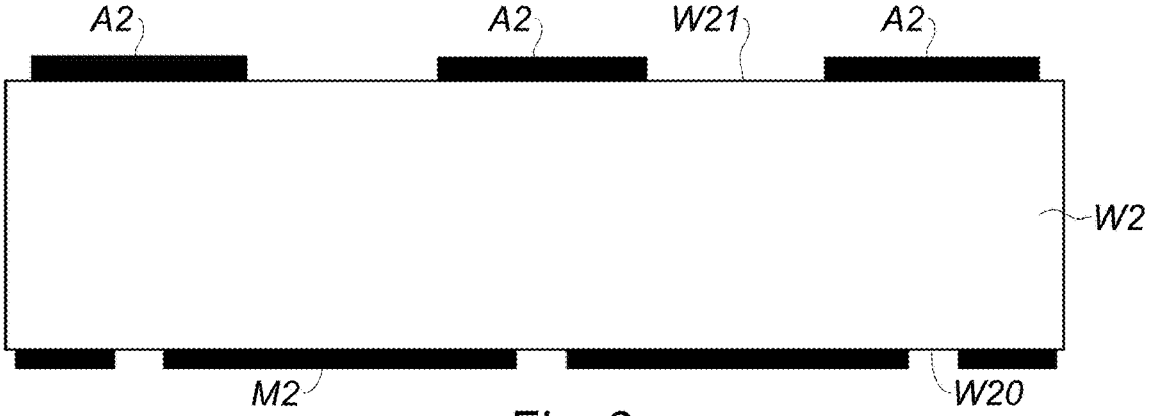
FIG. 2 is a partial schematic sectional view of a structure according to the invention, illustrating a first embodiment where the second wafer does not have any active components.
Figure 3:
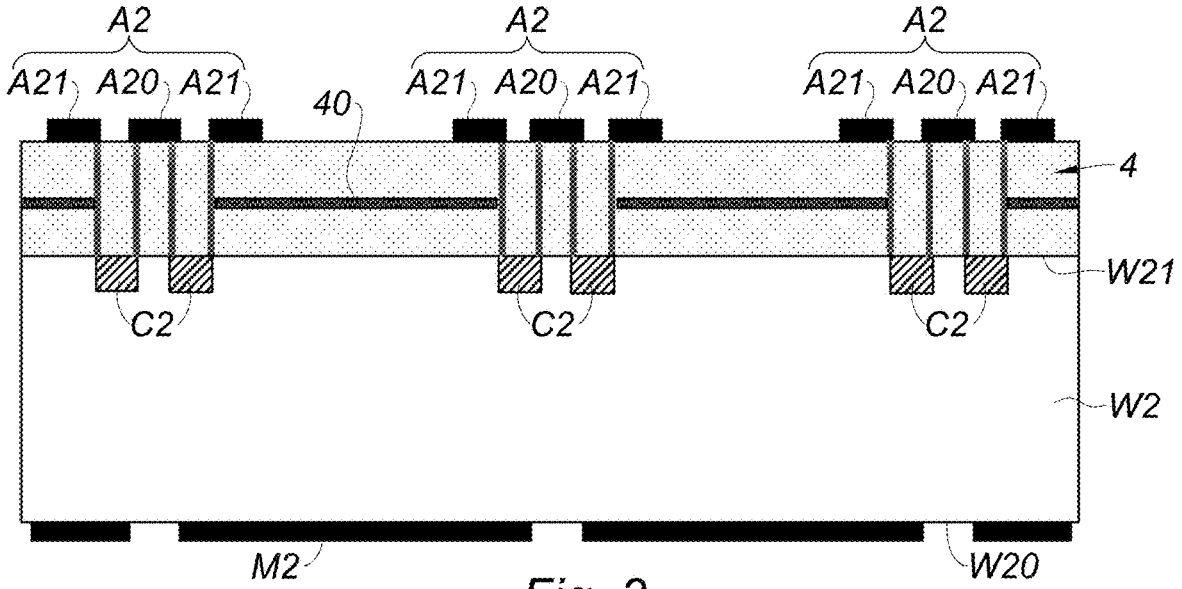
FIG. 3 is a partial schematic sectional view of a structure according to the invention, illustrating a second embodiment where the second wafer is provided with second active components.

The second wafer W2 is notably illustrated in FIGS. 2 and 3. The second wafer W2 is advantageously made from a semiconductor material, preferably selected from among silicon and germanium. The second wafer W2 may therefore be a semiconductor. The second wafer W2 may be based on a semiconductor material. The second wafer W2 may consist of a semiconductor material.

The second wafer W2 may also be made from a dielectric material such as quartz. It is also possible to contemplate a semiconductor-on-insulator (SeOI) second wafer W2, preferably a silicon-on-insulator (SOI) second wafer.

Second Active Components

The second wafer W2 advantageously comprises a set of second active components C2 configured so as to introduce a phase shift. The second active components C2 are advantageously integrated into the second wafer W2 by an FEOL ("Front-End-Of-Line") initial manufacturing unit, using for example photolithography, etching, dopant diffusion and implantation, metal deposition, passivation techniques known to a person skilled in the art. If the second wafer W2 is made from a dielectric material, the second active components C2 may be integrated into the second wafer W2 using thin-film deposition techniques.

Each second planar antenna A2 advantageously comprises separate first and second radiating surfaces A20, A21, separate in the sense that they are separated from one another by a separating region so as to be electrically isolated from one another. The set of second active components C2 advantageously comprises pairs of switches, each pair of switches being associated with a second planar antenna A2. Each pair of switches belongs to a phase shift circuit, and comprises first and second switches respectively alternately having an on state and an off state, the on or off states corresponding to a respectively authorized or blocked flow of a current between the separate first and second radiating surfaces A20, A21 of each second planar antenna A2. "Alternately" is understood to mean that the first switch alternates between the on state and the off state, while, simultaneously, the second switch alternates between the off state and the on state. In other words, at all times, the first and second switches belonging to the same phase shift circuit have two opposing states, either on/off or off/on. On/on or off/off states are not authorized.

The second active components C2 are advantageously chosen from among a diode, a field-effect transistor, a bipolar transistor, a microelectromechanical system. The field-effect transistor is preferably a MOS ("Metal Oxide Semiconductor") transistor. The diode may be a PIN diode, an electro-optical diode, or else a varactor diode. PIN diodes may be made from AlGaAs.

Second Metal Layer

The second metal layer M2 is preferably made from copper. The second metal layer may be formed on the first surface W20 of the second wafer W2 through a metallization process.

Second Interconnect Structure

The structure 1 advantageously comprises a second interconnect structure 4, formed on the second surface W21 of the second wafer W2, and electrically connected to the second active components C2. The second interconnect structure 4 is advantageously formed on the second surface W21 of the second wafer W2 by a BEOL ("Back-End-Of-Line") final manufacturing unit. The set of second planar antennas A2 is then formed on the second interconnect structure 4.

The second interconnect structure 4 comprises second bias lines 40 designed to bias the second active components C2. The second bias lines 40 are metal tracks, preferably made from copper.

The second wafer W2 advantageously comprises a second demultiplexer DMUX2 configured so as to transmit a control signal on the second bias lines 40. In order to limit the number of inputs (and therefore the number of wires), for the sake of compactness, it is possible to organize the second bias lines 40 in matrices, and to provide an address decoder.

Set of Second Planar Antennas

The set of second planar antennas A2 is formed on the second interconnect structure 4 such that each second planar antenna A2 is electrically connected to the second active components C2. The set of second planar antennas A2 is formed on the second interconnect structure 4 such that the second planar antennas A2 are electrically isolated from one another so as not to be short-circuited.

As mentioned above, each second planar antenna A2 advantageously comprises separate first and second radiating surfaces A20, A21, separate in the sense that they are separated from one another by a separating region so as to be electrically isolated from one another. To this end, a slot is advantageously formed in each second planar antenna A2 in order to electrically isolate the separate first and second radiating surfaces A20, A21. The slot defines the separating region. The slot is preferably annular, with a rectangular cross section. Of course, other shapes may be contemplated for the slot, such as an elliptical or circular shape. According to one variant implementation, the first and second radiating surfaces of the second planar antenna may be electrically isolated by a dielectric material.

The first and second radiating surfaces A20, A21 of the second planar antennas A2 are electrically connected to the second active components C2.

Joining of the First and Second Wafers

By way of non-limiting example, the ground plane PM may have a thickness of the order of 17 μm when the operating frequency of the transmitarray antenna 2 is 29 GHz.

The structure 1 advantageously comprises solder balls designed to establish a metallic bond between the first and second metal layers M1, M2. According to one alternative, the first and second wafers W1, W2 may be joined by way of the first and second metal layers M1, M2 through eutectic bonding.

The first and second wafers W1, W2 are joined such that the sets of the first and second planar antennas A1, A2 are aligned. The sets of the first and second planar antennas A1, A2 may be aligned using an alignment technique known to a person skilled in the art, for example using CCD ("Charge Coupled Device") cameras.

Figure 6:
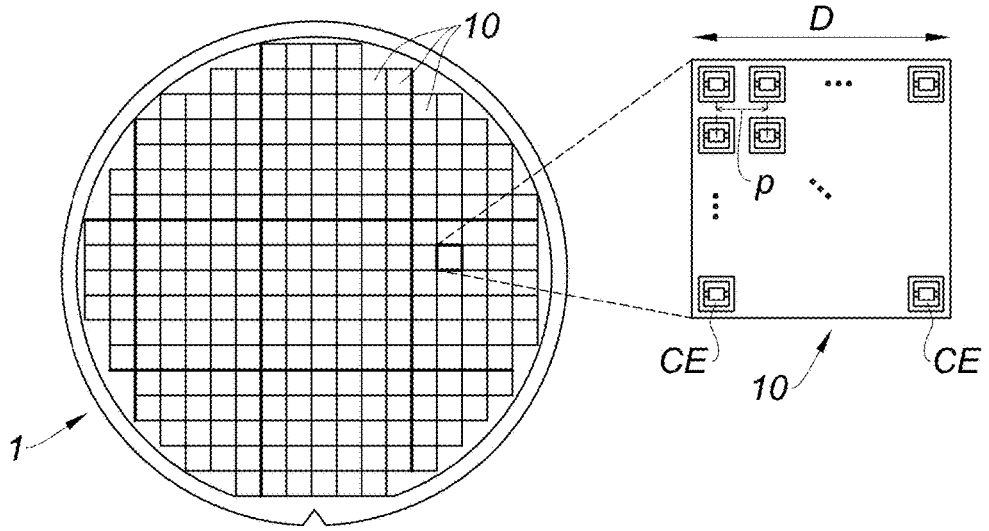
FIG. 6 is a schematic plan view of a structure according to the invention, illustrating the formation of patterns on the surface of the structure, for example through photolithography using a mask (reticle). The excerpt in FIG. 6 is a magnified plan view of a pattern, formed on the surface of the structure, and comprising a plurality of elementary cells.

After joining the first and second wafers W1, W2, the surface of the structure 1 is divided into patterns 10, as illustrated in FIG. 6. The patterns 10 are formed on the surface of the structure 1, for example through photolithography using a mask (reticle). By way of non-limiting example, each pattern 10 may be square in shape (D being the dimension of the sides) and may have a surface area of 20×20 $mm^2$ when the first and second wafers W1, W2 have a diameter of 200 mm. The number of elementary cells CE present in a pattern 10 depends on the operating frequency of the antenna 2, which defines the pitch p of the elementary cells CE. By way of non-limiting example, for an operating frequency of 28 GHz, a square pattern 10 with a surface area of 20×20 $mm^2$ may contain 3×3 elementary cells CE.

Electrical Connection Between the First and Second Planar Antennas

The structure 1 advantageously comprises vias V designed to electrically connect the first planar antennas A1 with the second planar antennas A2 facing them, the vias V being electrically isolated from the ground plane PM. The vias V pass through apertures formed in the ground plane PM. The apertures formed in the ground plane PM allow both electrical isolation with the vias V and the propagation of electromagnetic waves through the ground plane PM. When the first and second wafers W1, W2 are made of silicon, the vias V are TSVs ("Through Silicon Vias"). By way of example, for an operating frequency of 29 GHz, the vias V have a diameter of the order of 150 μm. The vias V are preferably connected to the first and second planar antennas A1, A2 by connection points. In general, the position of the connection points varies depending on the specific geometry of the planar antennas, so as to excite the fundamental mode of resonance. The vias V advantageously extend along the normal to the surfaces of the first and second planar antennas A1, A2.

When each first planar antenna A1 has separate first and second radiating surfaces A10, A11, the first radiating surfaces A10 of the first planar antennas A1 are electrically connected to the vias V.

When each second planar antenna A2 has separate first and second radiating surfaces A20, A21, the first radiating surfaces A20 of the second planar antennas A2 are electrically connected to the vias V.

Integrated Circuit

One subject of the invention is an integrated circuit IC, manufactured by cutting a structure 1 according to the invention, the cutting being performed such that the integrated circuit IC comprises a plurality of elementary cells CE, each comprising a first planar antenna A1 and a second planar antenna A2 facing it, so as to provide an electromagnetic lens function.

The cutting may be performed using a precision circular saw, with a metal core or resinoid diamond core blade. The cutting is performed along the normal to the surfaces W10, W11; W20, W21 of the first and second wafers W1, W2.

In other words, one subject of the invention is an integrated circuit IC, intended to provide an electromagnetic lens function for a reconfigurable transmitarray antenna 2, manufactured by cutting a structure 1 according to the invention, the integrated circuit IC comprising:

a portion of the first wafer W1, comprising first active components C1 configured so as to introduce a phase shift, and having opposing first and second surfaces W10, W11;

a part of the first metal layer M1, formed on the first surface W10 of the portion of the first wafer W1;

a part of the first interconnect structure 3, formed on the second surface W11 of the portion of the first wafer W1, and electrically connected to the first active components C1; the part of the first interconnect structure 3 comprising first bias lines 30 designed to bias the first active components C1;

a part of the set of first planar antennas A1, formed on the part of the first interconnect structure 3;

a portion of the second wafer W2, having opposing first and second surfaces W20, W21;

a part of the second metal layer M2, formed on the first surface W20 of the portion of the second wafer W2;

a part of the set of second planar antennas A2, formed on the second surface W21 of the portion of the second wafer W2;

the portions of the first and second wafers W1, W2 being joined by way of the parts of the first and second metal layers M1, M2 such that the parts of the sets of the first and second planar antennas A1, A2 are aligned, the parts of the first and second metal layers M1, M2 forming a ground plane PM.

The integrated circuit IC comprises a plurality of elementary cells CE, each comprising a first planar antenna A1 and a second planar antenna A2 facing it, so as to provide an electromagnetic lens function.

Reconfigurable Antenna

Figure 7:
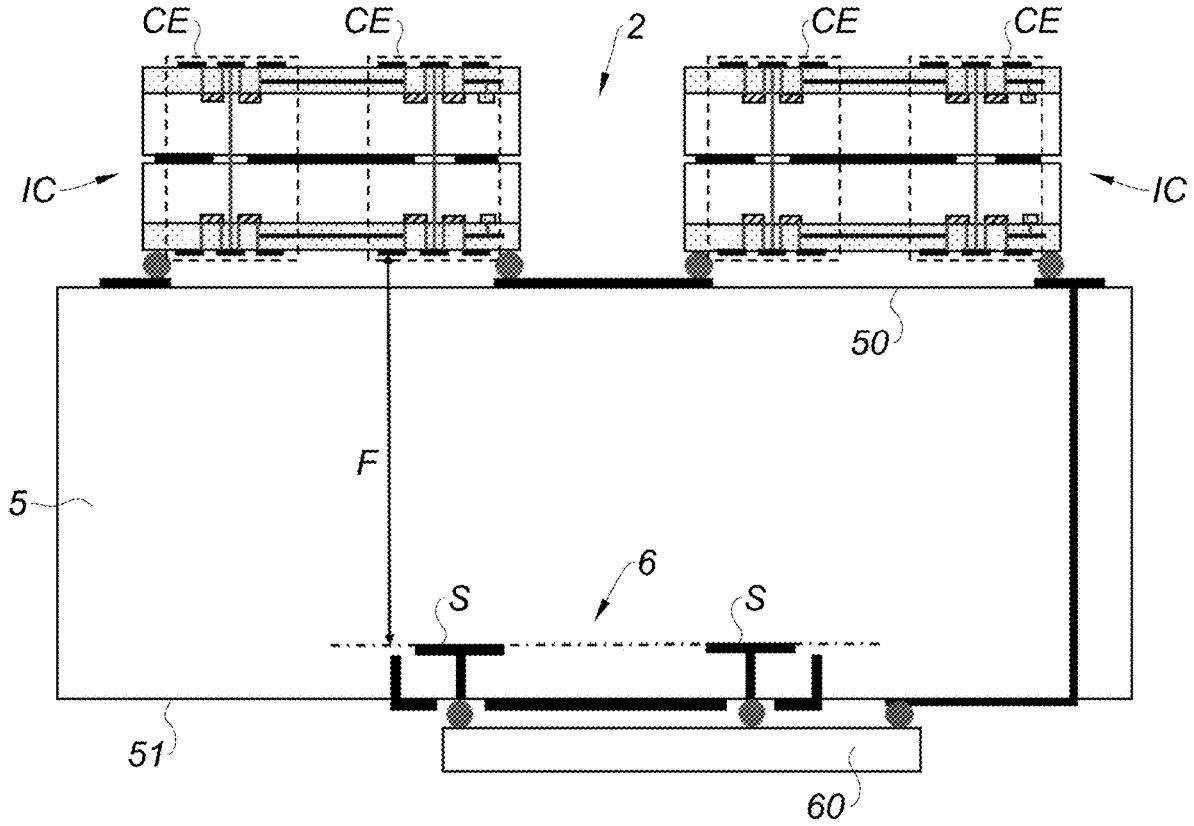
FIG. 7 is a schematic sectional view of a reconfigurable antenna according to the invention.

As illustrated in FIG. 7, one subject of the invention is a reconfigurable transmitarray antenna 2, comprising:

a printed circuit board 5, having opposing first and second surfaces 50, 51;

at least one integrated circuit IC according to the invention, formed on the first surface 50 of the printed circuit board 5;

at least one transceiver 6, designed to emit and receive an electromagnetic wave propagating within the printed circuit board 5;

at least one control electronics component 60, configured so as to control the transceiver 6 and the first active components C1 of the integrated circuit IC, and formed on the second surface 51 of the printed circuit board 5.

Printed Circuit Board

The printed circuit board 5 is made of a dielectric material. By way of non-limiting example, the printed circuit board 5 may be made of a commercial material such as RT/duroid® 6002. The printed circuit board 5 has a thickness typically of between 100 μm and 1500 μm for an operating frequency of the antenna 2 of between 10 GHz and 300 GHz. By way of non-limiting example, the printed circuit board 5 may have a thickness of the order of 254 μm when the operating frequency of the antenna 2 is 29 GHz.

Figure 8:
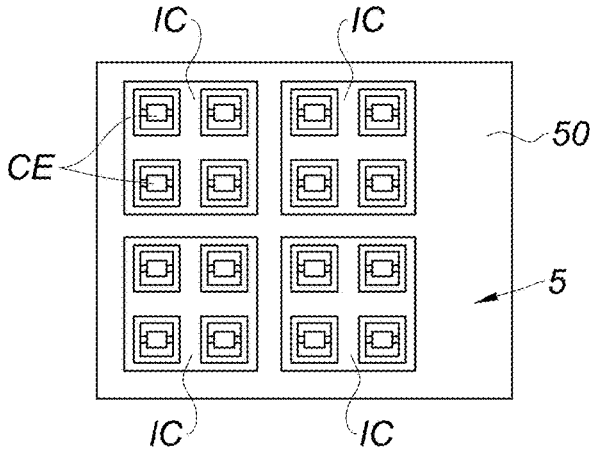
FIG. 8 is a schematic plan view of a reconfigurable antenna according to the invention.

The integrated circuit or integrated circuits IC may be formed on the first surface 50 of the printed circuit board 5 through a flip-chip bonding operation. The integrated circuits IC may be arranged on the first surface 50 of the printed circuit board 5 in the form of a matrix, as illustrated in FIG. 8.

Figure 9:
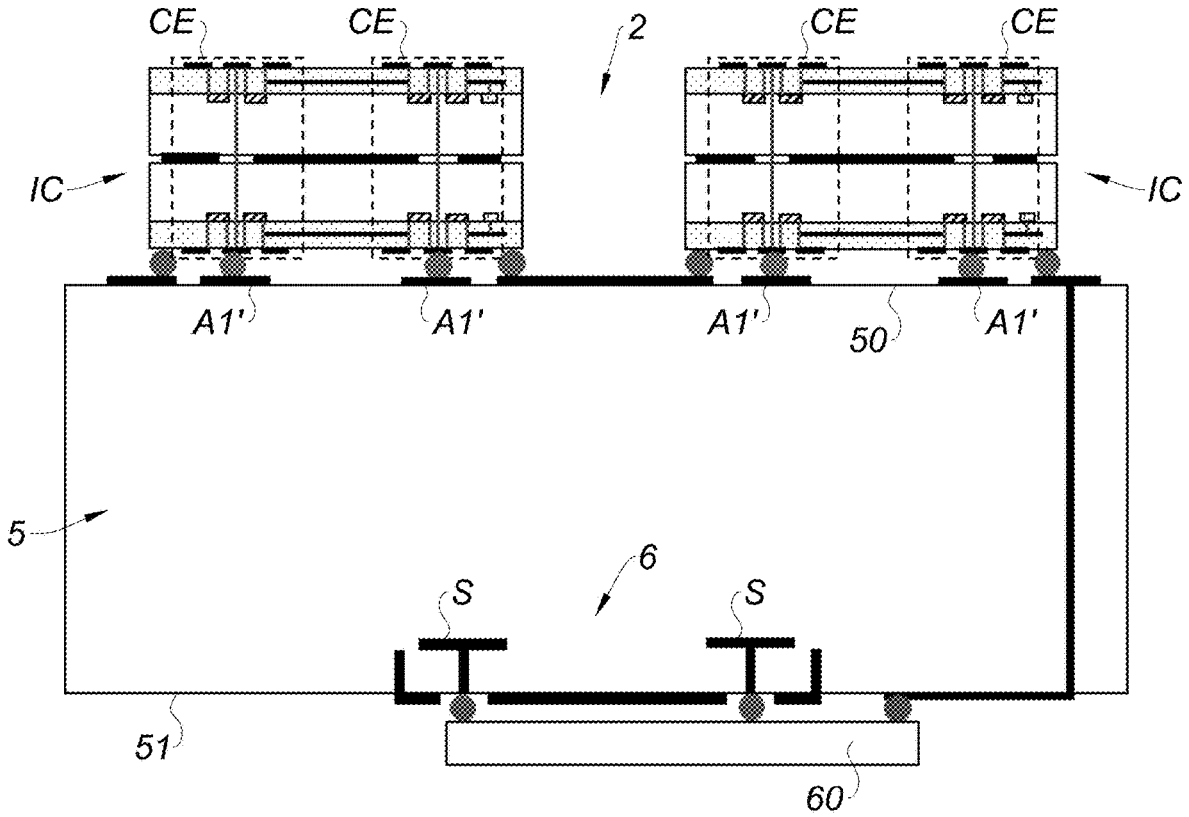
FIG. 9 is a schematic sectional view of a reconfigurable antenna according to the invention, illustrating an embodiment where additional planar antennas are formed on the surface of the printed circuit board.

As illustrated in FIG. 9, the antenna 2 advantageously comprises additional planar antennas A1' formed on the first surface 50 of the printed circuit board 5, and facing the elementary cells CE of the integrated circuit IC.

Transceiver

Each transceiver 6 comprises at least one radiating source S designed to emit electromagnetic waves. The radiating source S may be embodied in the form of a planar antenna formed within the printed circuit board 5, extending in a focal plane whose Euclidean distance to the electromagnetic lens defines the focal length F (illustrated in FIG. 7). The or each radiating source S is advantageously configured so as to operate at a frequency greater than 30 GHz (millimetre and sub-THz frequencies).

Figure 10:
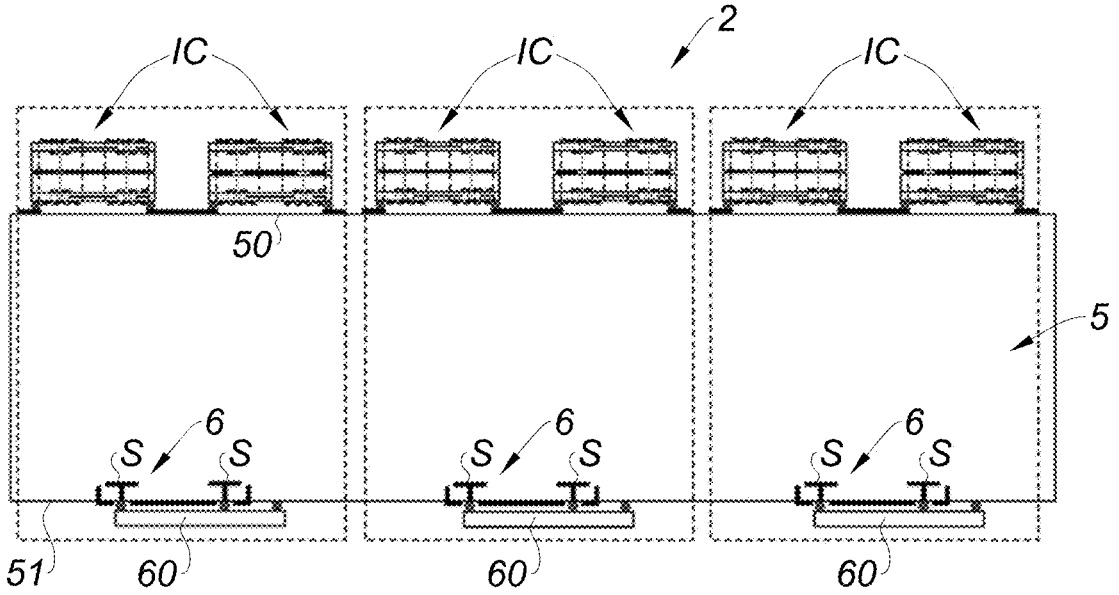
FIG. 10 is a schematic sectional view of a reconfigurable antenna according to the invention, illustrating an embodiment where the printed circuit board is provided with a plurality of transceiver modules. The dashed lines indicate a beamforming region over a bandwidth.

As illustrated in FIG. 10, the antenna 2 may comprise a plurality of transceivers 6. When the integrated circuits IC are arranged on the first surface 50 of the printed circuit board 5 in matrix form, each transceiver 6 may be dedicated to a region of the matrix.

Figure 11:
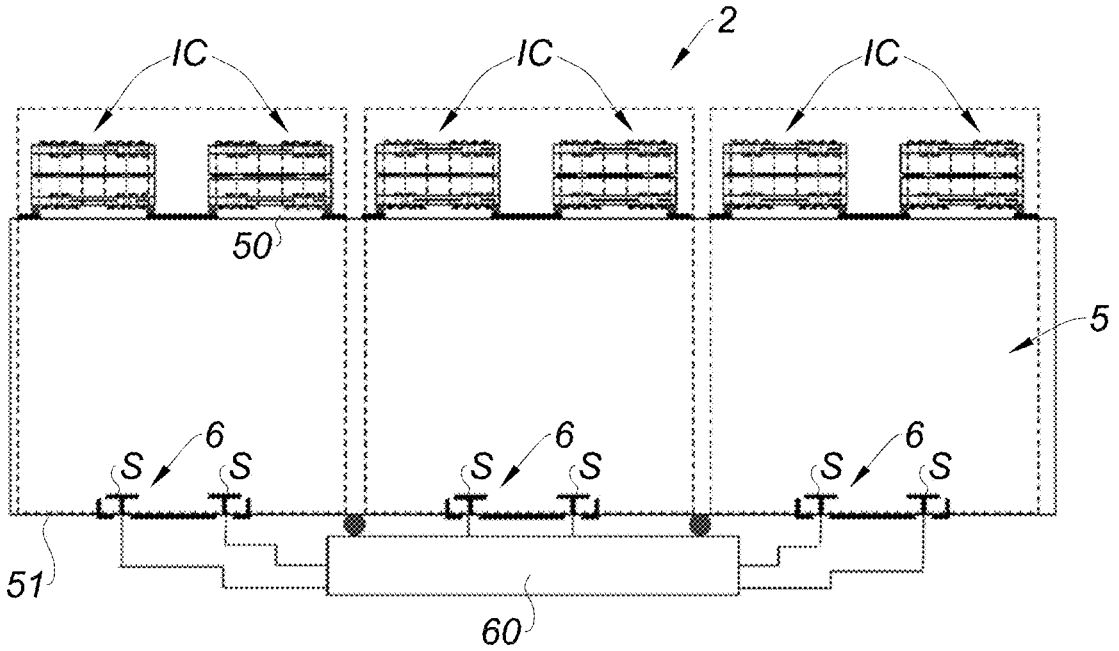
FIG. 11 is a schematic sectional view of a reconfigurable antenna according to the invention, illustrating an embodiment where the printed circuit board is provided with a digital transceiver module. The dashed lines indicate a beamforming region over a bandwidth.

As illustrated in FIG. 11, the plurality of transceivers 6 may be controlled by digital control electronics 60, the output channels of which are electrically connected to the radiating sources S.

Control Electronics

The control electronics 60 are preferably integrated within an electronic chip mounted on the second surface 51 of the printed circuit board 5. The control electronics 60 are advantageously configured so as to also control the second active components C2 of the integrated circuit IC.

In the absence of demultiplexers DMUX1, DMUX2 integrated into the first and second wafers W1, W2, demultiplexers may be moved to within the control electronics 60. One example of controlling bias lines is given in the doctoral thesis "Conception d'antennes à réseaux transmetteurs à dépointage et/ou formation de faisceau" [Design of depointing and/or beamforming transmitarray antennas], A. Clemente, October 2012, on pages 159-161.

The invention is not limited to the embodiments disclosed. A person skilled in the art has the ability to consider technically operative combinations thereof and to substitute them for equivalents.

The invention claimed is:

1. A structure for manufacturing integrated circuits that are intended to provide an electromagnetic lens function for a reconfigurable transmitarray antenna, the structure comprising:

a first wafer, comprising a set of first active components configured so as to introduce a phase shift, and having opposing first and second surfaces;

a first metal layer, formed on the first surface of the first wafer;

a first interconnect structure, formed on the second surface of the first wafer, and electrically connected to the first active components; the first interconnect structure comprising first bias lines designed to bias the first active components;

a set of first planar antennas, formed on the first interconnect structure;

a second wafer, having opposing first and second surfaces;

a second metal layer, formed on the first surface of the second wafer;

a set of second planar antennas, formed on the second surface of the second wafer;

the first and second wafers being joined by way of the first and second metal layers such that the sets of the first and second planar antennas are aligned, the first and second metal layers forming a ground plane.

2. The structure according to claim 1, wherein the set of first active components comprises pairs of switches, each pair of switches being associated with a first planar antenna.

3. The structure according to claim 1, wherein the first wafer comprises a first demultiplexer configured so as to transmit a control signal on the first bias lines.

4. The structure according to claim 1, wherein the second wafer comprises a set of second active components configured so as to introduce a phase shift; the structure further comprising a second interconnect structure, formed on the second surface of the second wafer, and electrically connected to the second active components; the second interconnect structure comprising second bias lines designed to bias the second active components; the set of second planar antennas being formed on the second interconnect structure.

5. The structure according to claim 4, wherein the set of second active components comprises pairs of switches, each pair of switches being associated with a second planar antenna.

6. The structure according to claim 4, wherein the second wafer comprises a second demultiplexer configured so as to transmit a control signal on the second bias lines.

7. The structure according to claim 1, further comprising vias designed to electrically connect the first planar antennas with the second planar antennas facing them, the vias being electrically isolated from the ground plane.

8. The structure according to claim 7, wherein each first planar antenna comprises separate first and second radiating surfaces; the first radiating surfaces of the first planar antennas being electrically connected to the vias; the second radiating surfaces of the first planar antennas being electrically connected to the first active components.

9. The structure according to claim 7, wherein the second wafer comprises a set of second active components configured so as to introduce a phase shift; the structure further comprising a second interconnect structure, formed on the second surface of the second wafer, and electrically connected to the second active components; the second interconnect structure comprising second bias lines designed to bias the second active components; the set of second planar antennas being formed on the second interconnect structure; wherein each second planar antenna comprises separate first and second radiating surfaces; the first radiating surfaces of the second planar antennas being electrically connected to the vias; the second radiating surfaces of the second planar antennas being electrically connected to the second active components.

10. The structure according to claim 1, wherein the first active components are chosen from among a diode, a field-effect transistor, a bipolar transistor, a microelectromechanical system.

11. The structure according to claim 1, further comprising solder balls designed to establish a metallic bond between the first and second metal layers.

12. The structure according to claim 1, wherein the first and second wafers are based on a semiconductor material, or consist of a semiconductor material.

13. An integrated circuit, intended to provide an electromagnetic lens function for a reconfigurable transmitarray antenna, the integrated circuit comprising:

a portion of a first wafer, comprising first active components configured so as to introduce a phase shift, and having opposing first and second surfaces;

a part of a first metal layer, formed on the first surface of the portion of the first wafer;

a part of a first interconnect structure, formed on the second surface of the portion of the first wafer, and electrically connected to the first active components; the part of the first interconnect structure comprising first bias lines designed to bias the first active components;

a part of a set of first planar antennas, formed on the part of the first interconnect structure;

a portion of a second wafer, having opposing first and second surfaces;

a part of the second metal layer, formed on the first surface of the portion of the second wafer;

a part of a set of second planar antennas, formed on the second surface of the portion of the second wafer;

the portions of the first and second wafers being joined by way of the parts of the first and second metal layers such that the parts of the sets of the first and second planar antennas are aligned, the parts of the first and second metal layers forming a ground plane, the integrated circuit comprising a plurality of elementary cells, each comprising a first planar antenna and a second planar antenna facing it, so as to provide an electromagnetic lens function.

14. A reconfigurable transmitarray antenna, comprising:

a printed circuit board, having opposing first and second surfaces;

at least one integrated circuit according to claim 13, formed on the first surface of the printed circuit board;

at least one transceiver, designed to emit and receive an electromagnetic wave propagating within the printed circuit board;

at least one control electronics component, configured so as to control the transceiver and the first active components of the at least one integrated circuit, and formed on the second surface of the printed circuit board.

15. The antenna according to claim 14, wherein the at least one integrated circuit is manufactured by cutting the first interconnect structure, and the at least one control electronics component is configured so as to control second active components of the at least one integrated circuit.

16. The antenna according to claim 14, further comprising additional planar antennas formed on the first surface of the printed circuit board, and facing the elementary cells of the at least one integrated circuit.

* * * * *